US005745080A

United States Patent [19]

Jun

[11] Patent Number: 5,745,080

[45] Date of Patent: Apr. 28, 1998

[54] FLAT ANTENNA STRUCTURE

[75] Inventor: Joo-Sung Jun, Kyungki-do, Rep. of Korea

[73] Assignee: L.G. Electronics Inc., Rep. of Korea

[21] Appl. No.: 871,642

[22] Filed: Jun. 9, 1997

Related U.S. Application Data

[63] Continuation of Ser. No. 523,924, Sep. 6, 1995, abandoned.

[30] Foreign Application Priority Data

Sep. 6, 1994 [KR] Rep. of Korea ..... 22383

[51] Int. Cl.[6] ..... H01Q 1/38

[52] U.S. Cl. ..... 343/700 MS; 343/846

[58] Field of Search ..... 343/700 MS, 767, 343/770, 795, 797, 829, 846, 848, 830; H01Q 21/24, 21/26, 1/38

[56] References Cited

U.S. PATENT DOCUMENTS 4,816,835 3/1989 Abiko et l. ..... 343/700 MS
4,857,938 8/1989 Tsukamoto et la. ..... 343/700 MS
4,929,959 5/1990 Sorbello et al. ..... 343/700 MS
5,231,406 7/1993 Sreemivas ..... 343/700 MS
5,243,353 9/1993 Nakahara et al. ..... 343/700 MS
5,453,751 9/1995 Tsukamoto e tla. ..... 343/700 MS

*Primary Examiner*—Donald T. Hajec
*Assistant Examiner*—Tho Phan
*Attorney, Agent, or Firm*—Fish & Richardson P.C.

[57] ABSTRACT

A flat antenna structure is obtained by sequentially stacking a first foam agent on a dielectric earth conductor substrate, a radiating element substrate for radiating an electromagnetic wave on the first foam agent, a second foam agent on the radiating element substrate, and a slot substrate. The slot substrate is formed with plural parasitic elements and rectangular slots for finally radiating the electromagnetic wave from the radiating element substrate and for blocking unnecessary radiation of the electromagnetic wave from the radiating element substrate on the second foam agent. This structure enhances the efficiency of the antenna and allow the antenna to selectively receive two adjacent satellite broadcasts.

14 Claims, 11 Drawing Sheets

FLAT ANTENNA STRUCTURE

This application is a continuation of U.S. application Ser. No. 08/523,924, filed Sep. 6, 1995, now abandoned.

BACKGROUND OF THE INVENTION

The present invention relates to a flat antenna structure, and more particularly to a flat antenna structure capable of increasing efficiency of an antenna and selectively receiving two polarized waves.

The frequency band of a satellite currently broadcasting over Asia ranges from 11.7 GHz to 12.2 GHz, and has a frequency band of about 500 MHz.

Parabola and flat antennas are employed to receive a satellite broadcast in the above frequency band. Flat antennas use a photolithography system to enable mass production, and are too light and small to be restricted in installation space.

FIG. 1 is an exploded perspective view showing one example of a conventional flat antenna using two substrates, FIG. 2*a* is a plan view showing the radiating element substrate and FIG. 2*b* is a plan view showing the circular slot substrate of FIG. 1.

As illustrated in FIG. 1, a conventional flat antenna using two substrates is formed such that a dielectric earth conductor substrate 1, a radiating element substrate 2 for radiating an electromagnetic wave and a circular slot substrate 3 for blocking unnecessary radiation of the electromagnetic wave radiated from radiating element substrate 2 are disposed by interposing foam agents 4 and 5. These are stacked in the sequence of earth conductor substrate 1, foam agent 4, radiating element substrate 2, foam agent 5 and circular slot substrate 3.

Radiating element substrate 2 of FIG. 1 stacked for the flat antenna is provided with a plurality of radiating elements 6 and electric power supply lines 7, as shown in FIG. 2*a*. Radiating element 6 is a circular patch having a tap 6A at 45° site centering about electric power supply line 7, and electric power supply line 7 is provided for supplying an electromagnetic energy to radiating element 6.

As shown in FIG. 2*b*, circular slot substrate 3 of FIG. 1 stacked for the flat antenna is provided with a plurality of circular slots 8 shaped identical to radiating elements 6 of radiating element substrate 2.

In the flat antenna constructed as above, radiating elements 6 formed on radiating element substrate 2 are supplied with the electromagnetic energy from electric power supply lines 7 to radiate the electromagnetic wave. At this time, the electromagnetic wave radiated from radiating element 6 is converted into a circularly polarized wave by means of tap 6A formed at 45° site centering about electric power supply lines 7, thereby receiving the satellite broadcasting.

The size of radiating element 6 can be obtained by the electromagnetic field numerical analysis, and parameter values such as a dielectric constant Eγ, a thickness and a conductor thickness are required for obtaining the size thereof.

As illustrated in FIG. 2*a*, electric power supply lines 7 are shaped as steps for impedance matching and phase matching with radiating elements 6.

The above-described flat antenna is effective in controlling unnecessary radiation at a discontinuous portion of electric power supply line 7, however, the gain of the antenna is lowered in accordance with the size of circular slots 8 of circular slot substrate 3 stacked above radiating elements 6.

FIG. 3 is an exploded perspective view showing another example of the conventional flat antenna using three substrates, FIG. 4*a* is a plan view showing the radiating element substrate of FIG. 3, FIG. 4*b* is a plan view of the rectangular slot substrate of FIG. 3, and FIG. 4*c* is a plan view showing a parasitic element substrate of FIG. 3.

The conventional flat antenna using three substrates, as illustrated in FIG. 3, is formed in such that a dielectric earth conductor substrate 10, a radiating element substrate 11 for radiating an electromagnetic wave, a rectangular slot substrate 12 for blocking unnecessary radiation of the electromagnetic wave radiated from radiating element substrate 11 and a parasitic element substrate 13 for emitting the electromagnetic wave radiated from radiating element substrate 11 are disposed by interposing foam agents 14, 15 and 16, respectively. These are stacked in the sequence of earth conductor substrate 10, foam agent 14, radiating element substrate 11, foam agent 15, rectangular slot substrate 12, foam agent 16 and parasitic element substrate 13.

Here, radiating element substrate 11 of FIG. 3 stacked for the flat antenna shown in FIG. 3 is provided with a plurality of radiating elements 17 and electric power supply lines 18 for radiating the electromagnetic wave as illustrated in FIG. 4*a*. Here, radiating element 17 is provided for radiating the electromagnetic wave, and electric power supply line 18 is for supplying an electromagnetic energy to radiating element 17.

As shown in FIG. 4*b*, rectangular slot substrate 12 of FIG. 3 stacked for the flat antenna is provided with a plurality of rectangular slots 19 shaped identical to radiating elements 17 of radiating element substrate 11.

Referring to FIG. 4*c*, parasitic element substrate 13 of FIG. 3 stacked for the flat antenna is formed with parasitic elements 20 for emitting the electromagnetic wave radiated from radiating element 17 of radiating element substrate 11.

In the flat antenna constructed as above, radiating element 17 formed in radiating element substrate 11 is supplied with the electromagnetic energy from electric power supply line 18 to radiate the electromagnetic wave, and parasitic element 20 formed in parasitic element substrate 13 externally radiates the electromagnetic wave radiated from radiating element 17.

At this time, electric power supply lines 18 for supplying the electromagnetic energy to radiating elements 17 are arranged within a space by being inserted into rectangular slot substrate 12, so that the unnecessary radiation does not occur at the electric power supply lines 17.

Although the conventional flat antenna using three substrates can obstruct the gain of the antenna from being lowered in accordance with the slot size, three substrates are employed to raise manufacturing cost, thereby reducing the economical efficiency.

In addition, since only a single polarized wave is receivable by the conventional flat antenna, adjacent two satellite broadcastings cannot be selectively received.

SUMMARY OF THE INVENTION

The present invention is devised to solve the above-described problems. Accordingly, it is an object of the present invention to provide a flat antenna structure for improving efficiency of the antenna and enabling selective reception of two polarized waves.

To achieve the above object of the present invention, there is provided a flat antenna structure, in which a first foam agent is stacked on a dielectric earth conductor substrate and a radiating element substrate for radiating an electromagnetic wave is stacked on the first foam agent. A second foam agent is stacked on the radiating element substrate, and a slot substrate is stacked on the second foam agent and formed with a plurality of parasitic elements and rectangular slots for final radiation of the electromagnetic wave radiated from the radiating element substrate to block unnecessary radiation of the electromagnetic wave from the radiating element substrate.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
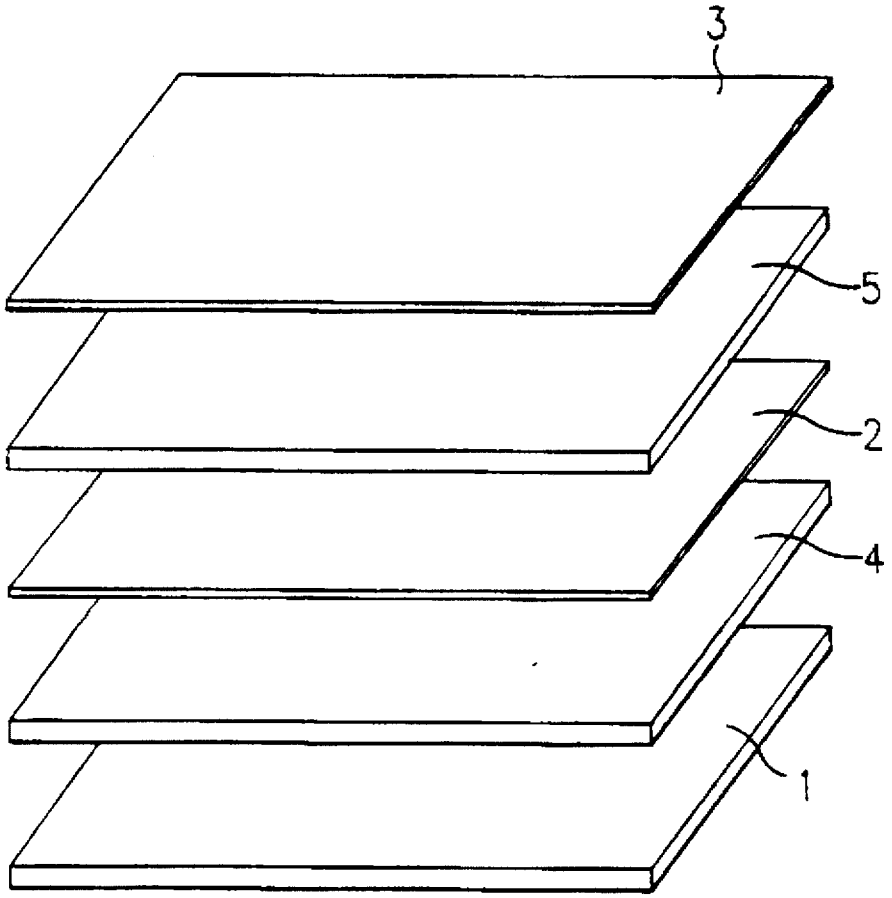
FIG.1 prior art
FIG. 1 is an exploded perspective view showing one example of a conventional flat antenna using two substrates.
Figure 2A:
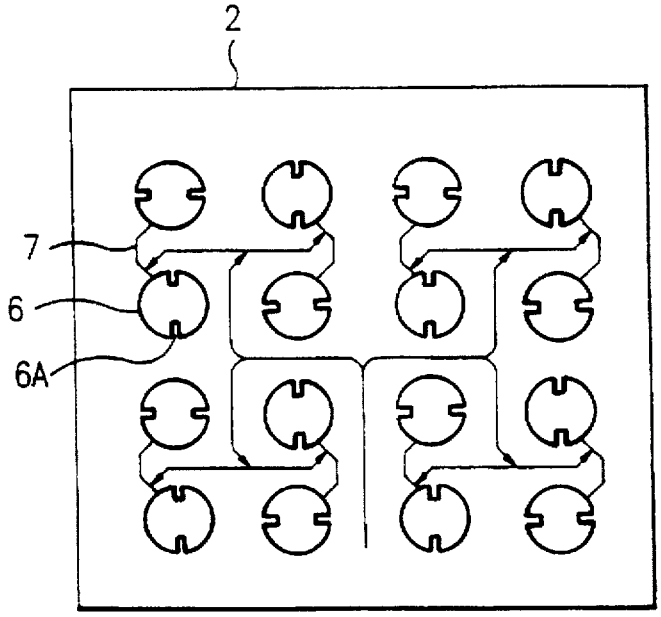
FIG.2a prior art
FIG. 2*a* is a plan view showing the radiating element substrate of FIG. 1.
Figure 2B:
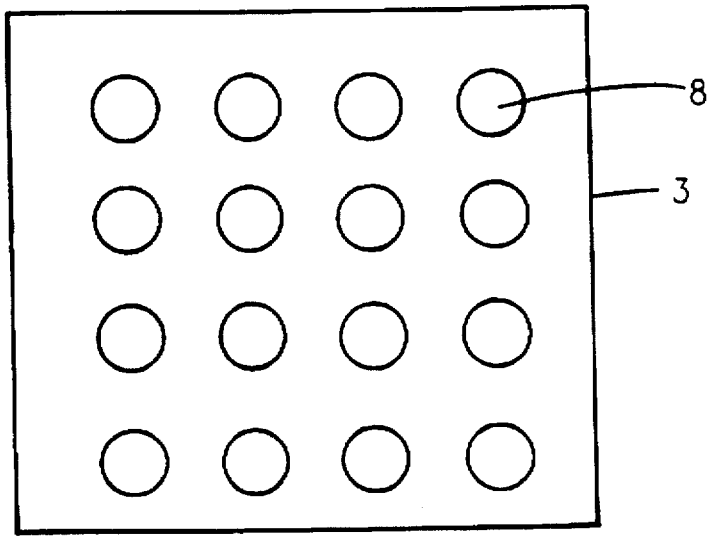
FIG.2b prior art
FIG. 2*b* is a plan view showing the circular slot substrate of FIG. 1.
Figure 3:
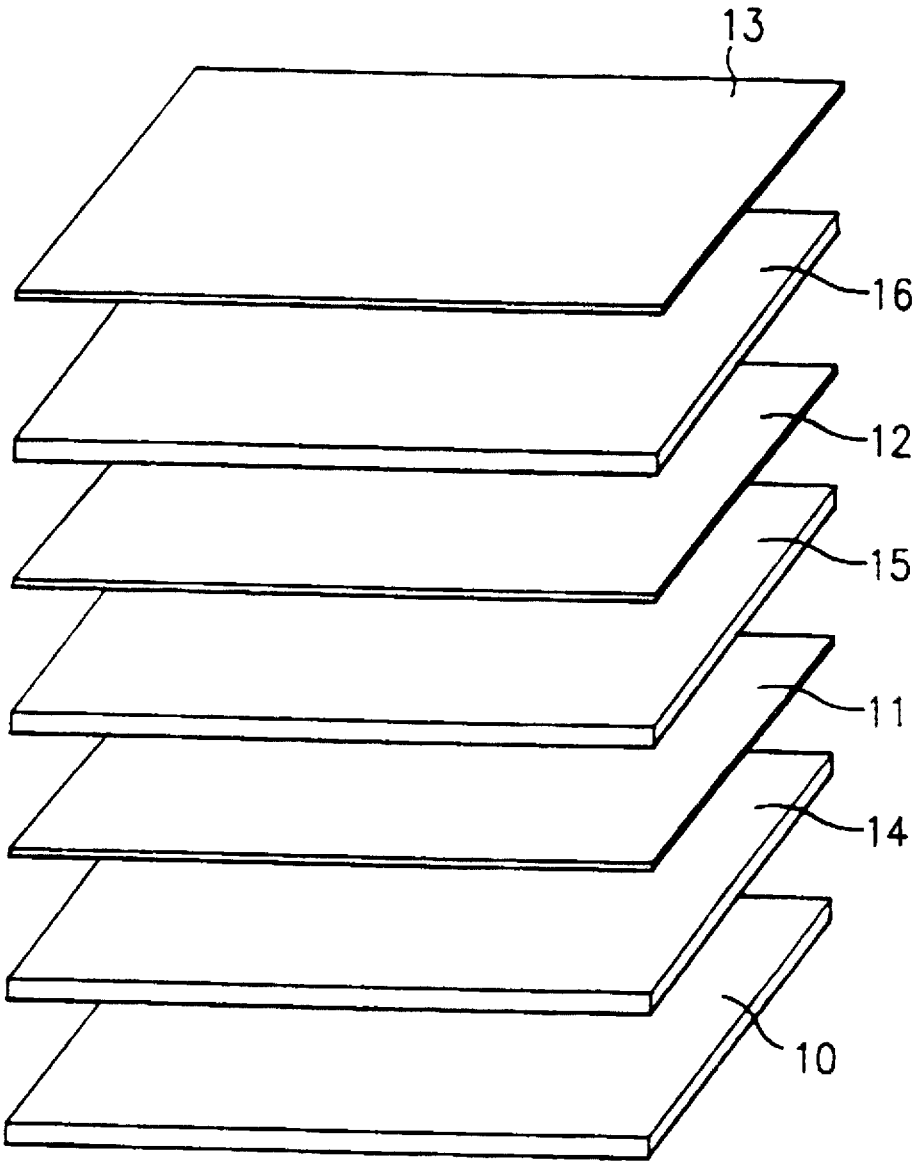
FIG.3 prior art
FIG. 3 is an exploded perspective view showing another example of the conventional flat antenna using three substrates.
Figure 4A:
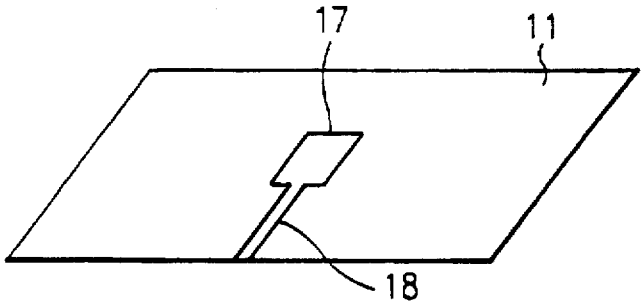
FIG.4a prior art
FIG. 4*a* is a plan view showing the radiating element substrate of FIG. 3.
Figure 4B:
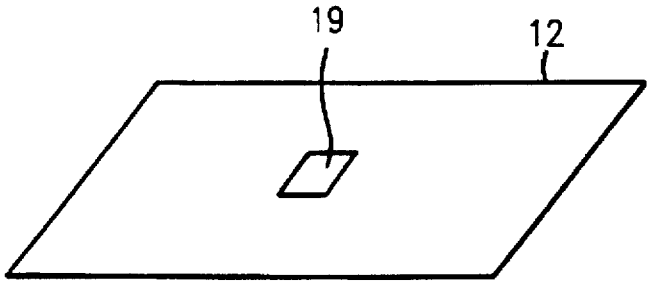
FIG.4b prior art
FIG. 4*b* is a plan view showing the rectangular slot substrate of FIG. 3.
Figure 4C:
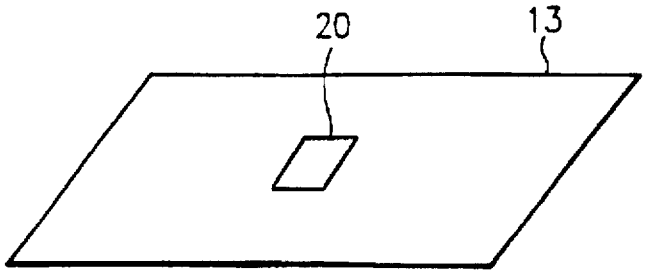
FIG.4c prior art
FIG. 4*c* is a plan view showing the parasitic element substrate of FIG. 3.
Figure 5:
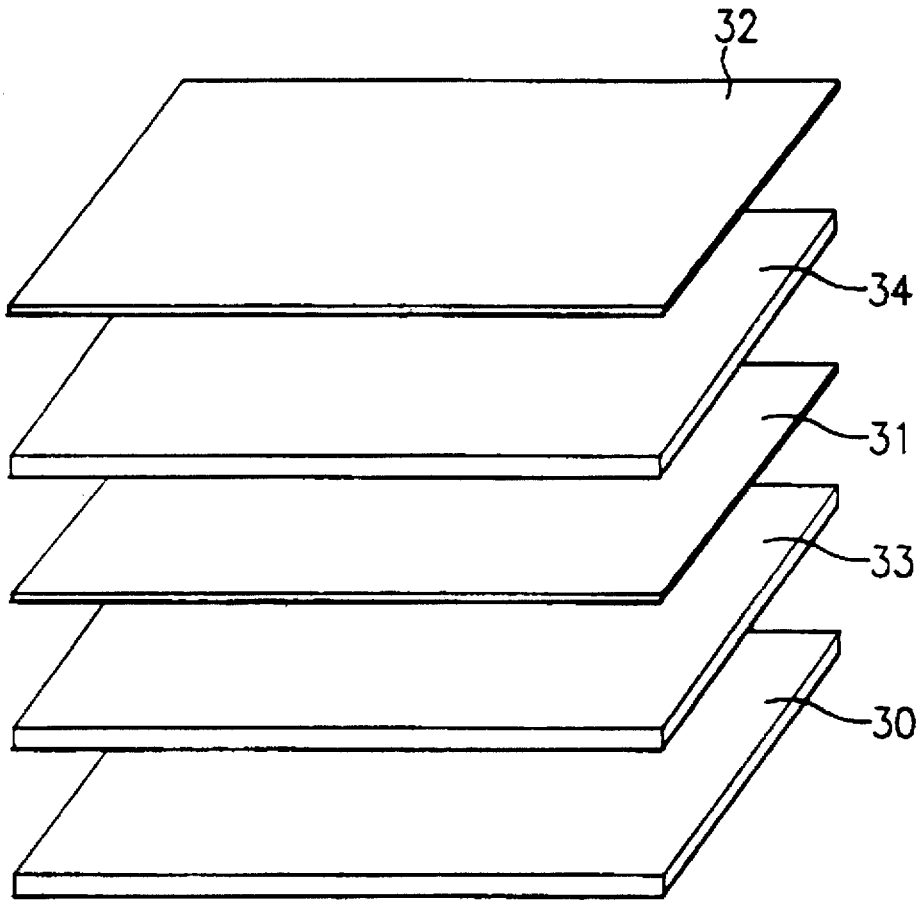
FIG. 5 is an exploded perspective view showing one embodiment of a flat antenna according to the present invention.

Referring to FIG. 5, one embodiment of a flat antenna according to the present invention is constructed by an earth conductor substrate 30 being a dielectric, a radiating element substrate 31 for radiating an electromagnetic wave and a slot substrate 32 for blocking unnecessary radiation of the electromagnetic wave radiated from radiating element substrate 31 are disposed by interposing foam agents 33 and 34. These are stacked in the sequence of earth conductor substrate 30, foam agent 33, radiating element substrate 31, foam agent 34 and slot substrate 32.

Figure 6A:
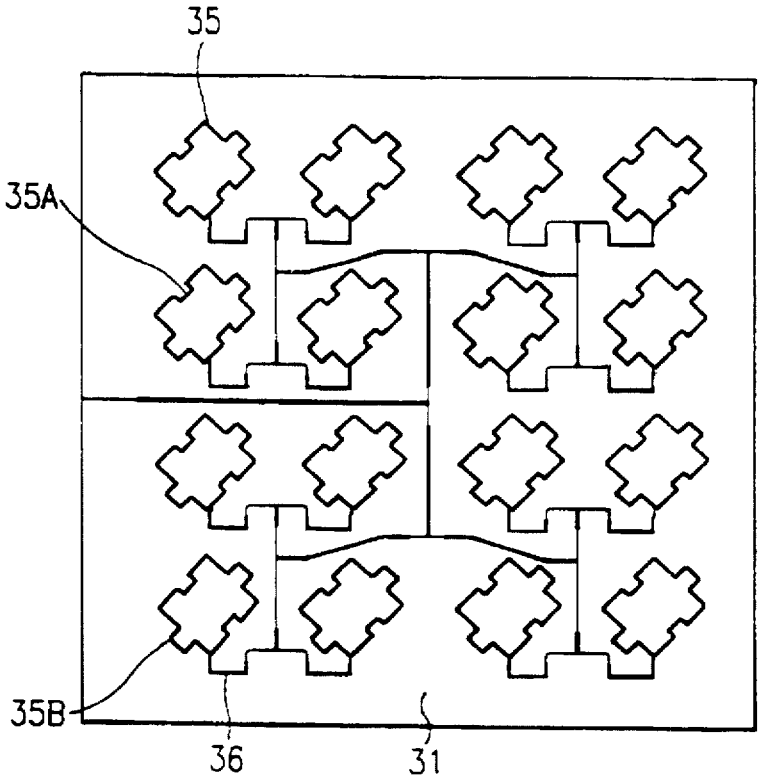
FIG. 6*a* is a plan view showing the radiating element substrate of FIG. 5.

Radiating element substrate 31, as shown in FIG. 6*a*, is provided with a plurality of radiating elements 35 respectively having a tap 35A and a cap 35B for radiating by two orthogonal modes, and electric power supply lines 36 for supplying an electromagnetic energy.

Figure 7A:
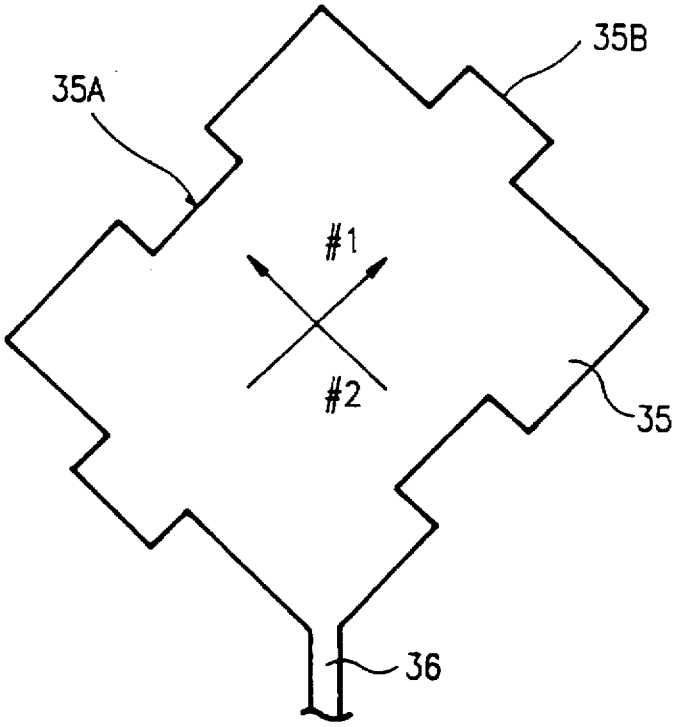
FIG. 7*a* is a plan view of the rectangular radiating element of FIG. 6*a;*
Figure 7B:
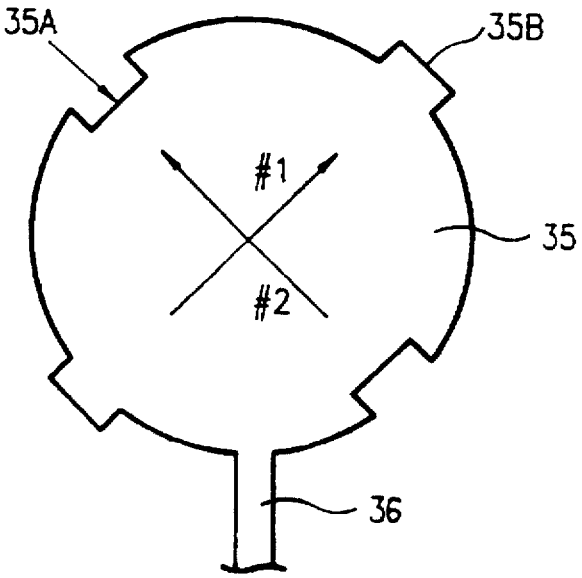
FIG. 7*b* is a plan view showing the circular radiating element of FIG. 6*a;*

Radiating element 35 employs a rectangular radiating element as shown in FIG. 7*a*, or a circular radiating element as shown in FIG. 7*b*, in which either the rectangular radiating element or the circular radiating element exert the same effect.

Also, two orthogonal modes are radiated in a phase difference of 90° having the same amplitude at a central frequency $f_0$ in accordance with the sizes of tap 35A and cap 35B.

Electric power supply lines 36 for supplying the electromagnetic energy to radiating elements 35 include impedance transformers at respective branches for impedance matching and phase matching with radiating elements 35.

Figure 6B:
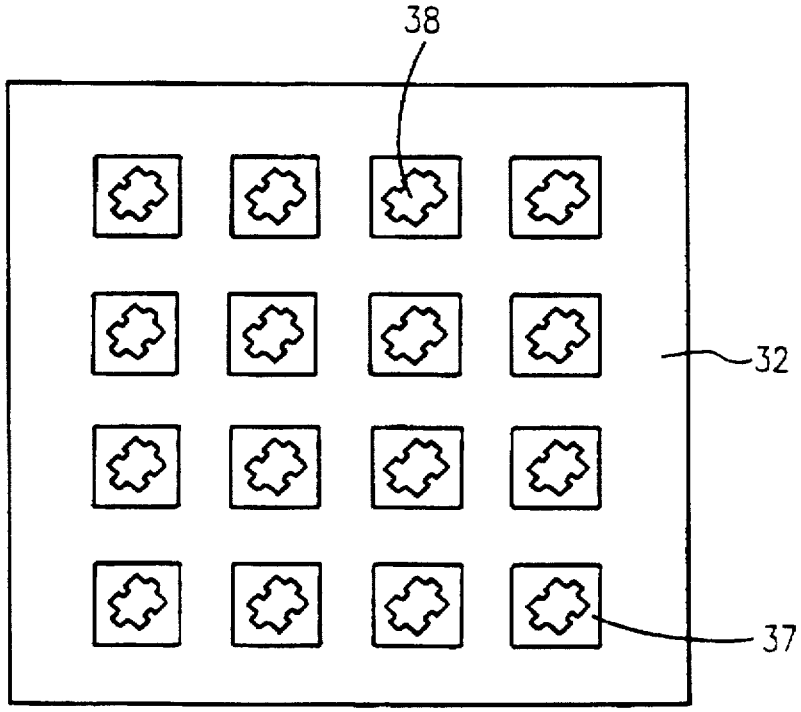
FIG. 6*b* is a plan view showing the slot substrate of FIG. 5.

As illustrated in FIG. 6*b*, slot substrate 32 is formed with a plurality of parasitic elements 38 and rectangular slots 37.

Here, radiating element substrate 31 and slot substrate 32 are stacked to allow a plurality of radiating elements 35 and parasitic elements 38 to oppose to one another.

Parasitic element 38 is shaped and numbers to be the same as radiating element 35. The size of parasitic element 38 is obtained by the electromagnetic-field numerical analysis, which is mostly smaller than radiating element 35 as it is supplied with no electric power.

Since the size of rectangular slot 37 affects sensitively to efficiency of the antenna, it should be greater than $\lambda g/2$ of central frequency $f_0$ for enhancing the efficiency of the antenna.

The reference symbol $\lambda g$ denotes a guide wavelength which is obtained by the following equation:

$$\lambda g = \frac{c}{f\sqrt{\epsilon re}}$$

where reference symbol c denotes the velocity of light, f is the frequency and $\epsilon re$ is an effective dielectric constant.

An operation of one embodiment of the flat antenna according to the present invention constructed as above will be described as below.

Radiating element 35 of radiating element substrate 31 radiates the electromagnetic energy from electric power supply line 36 as the electromagnetic wave, and two orthogonal modes #1 and #2 are produced since radiating element 35 is provided with tap 35A and cap 35B as illustrated in FIGS. 7*a* and 7*b*.

Figure 8A:
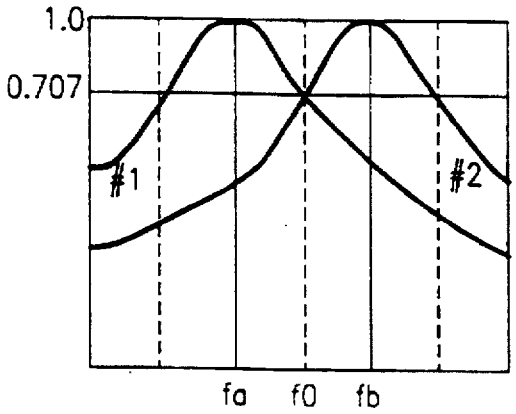
FIG. 8*a* represents a waveform plotting the amplitude characteristic of the radiating element of FIG. 7.
Figure 8B:
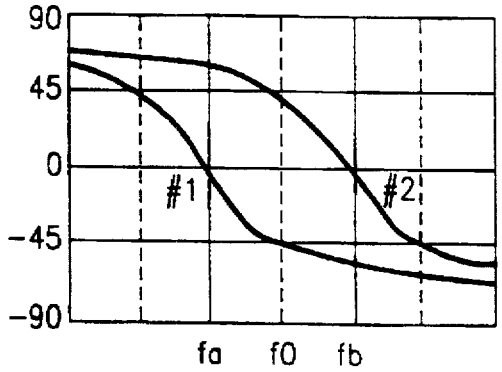
FIG. 8*b* represents a waveform plotting the phase characteristic of the radiating element of FIG. 7.

Two orthogonal modes #1 and #2 have the same amplitude at central frequency $f_0$ in accordance with tap 35A and 35B of the optimum sizes as plotted in FIG. 8*a*, and are radiated in the phase difference of 90° as plotted in FIG. 8*b*.

More specifically, as shown in FIG. 8*a*, two orthogonal modes #1 and #2 are radiated to have the highest amplitude symmetrical at frequencies fa and fb about central frequency $f_0$, and radiated to be identical to each other with the amplitude corresponding to 0.707 times of the highest amplitude at central frequency $f_0$.

Also, as shown in FIG. 8*b*, two orthogonal modes #1 and #2 are presented to respectively have the phase of −45° and +45° at central frequency $f_0$, thereby being radiated with the phase difference of 90°.

At this time, the optimum size of radiating element 35 can be obtained by the electromagnetic field numerical analysis.

Even though the impedance transformer is provided to electric power supply line 36, the unnecessary radiation appears at the discontinuous portion of electric power supply line 36 to lower the gain of the antenna. Thus, rectangular slots 37 and plurality of parasitic elements 38 are formed in the same slot substrate 32 which is stacked on radiating element substrate 31.

Figure 9:
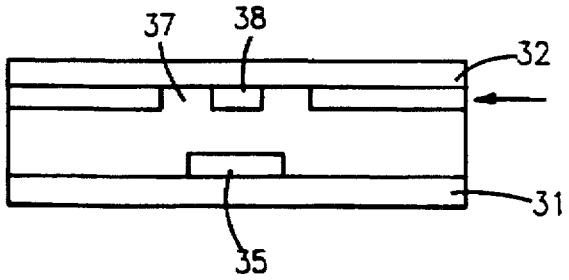
FIG. 9 is a sectional view showing a portion of the flat antenna of FIG. 5.

Meantime, the electromagnetic wave radiated from radiating element 35 formed in radiating element substrate 31 is efficiently radiated by parasitic element 38 formed in slot substrate 32 in such a manner that, as shown in FIG. 9, the electromagnetic wave is transmitted in the direction of an arrow (←) to slot substrate 32 stacked as being opposed to radiating element substrate 31, thereby finally being radiated by parasitic element 38.

Figure 10:
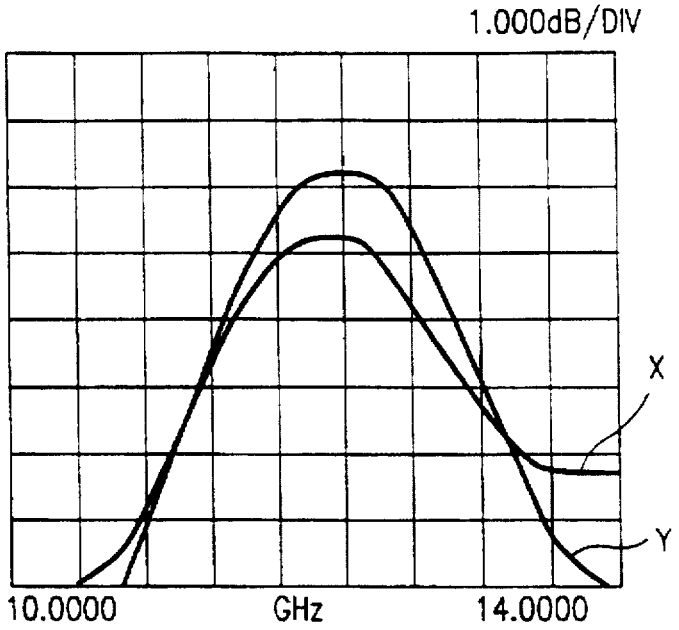
FIG. 10 represents a waveform plotting the gain characteristic of the flat antenna of FIG. 5.

A gain Y resulting from one embodiment of the flat antenna according to the present invention is higher than a gain X of the conventional flat antenna by as many as roughly 0.9 dB, as illustrated in FIG. 10.

Another embodiment of the flat antenna according to the present invention is provided for receiving dual polarized wave, which further stacks an electric power supplying circuit board 40 and a foam agent 41 to one embodiment of the flat antenna.

Figure 11:
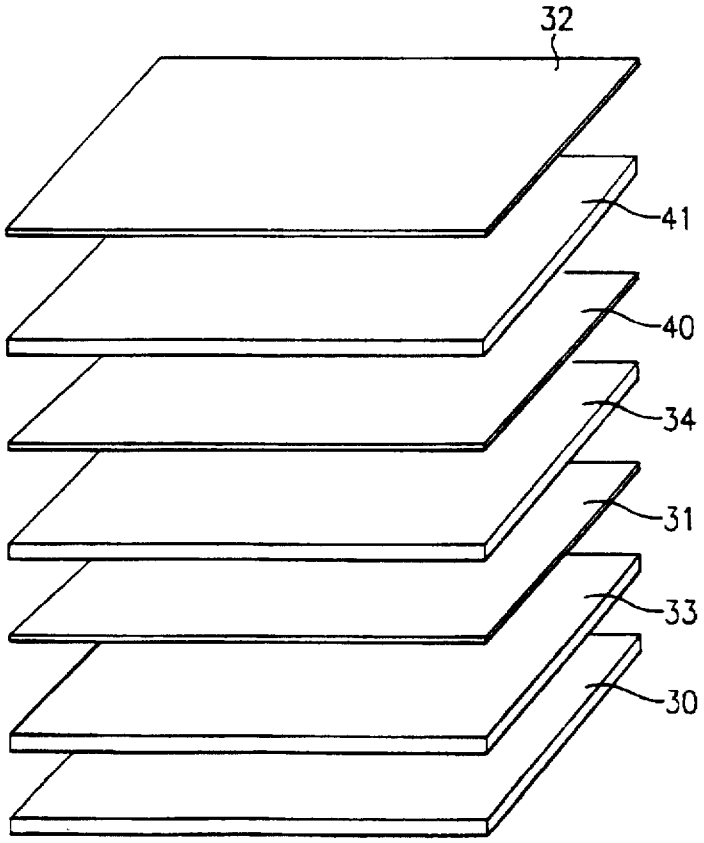
FIG. 11 is an exploded perspective view showing another embodiment of the flat antenna according to the present invention.

In more detail, as illustrated in FIG. 11, another embodiment of the flat antenna according to the present invention includes earth conductor substrate 30 being the dielectric, radiating element substrate 31 for radiating the electromagnetic wave, electric power supplying circuit board 40 for enabling the selective reception of adjacent two satellite broadcastings, and slot substrate 32 for blocking the unnecessary radiation of the electromagnetic wave radiated from radiating element substrate 31, which are disposed by interposing foam agents 33, 34 and 41. These parts are stacked in the sequence of earth conductor substrate 30, foam agent 33, radiating element substrate 31, foam agent 34, electric power supplying circuit substrate 40, foam agent 41 and slot substrate 32.

Figure 12:
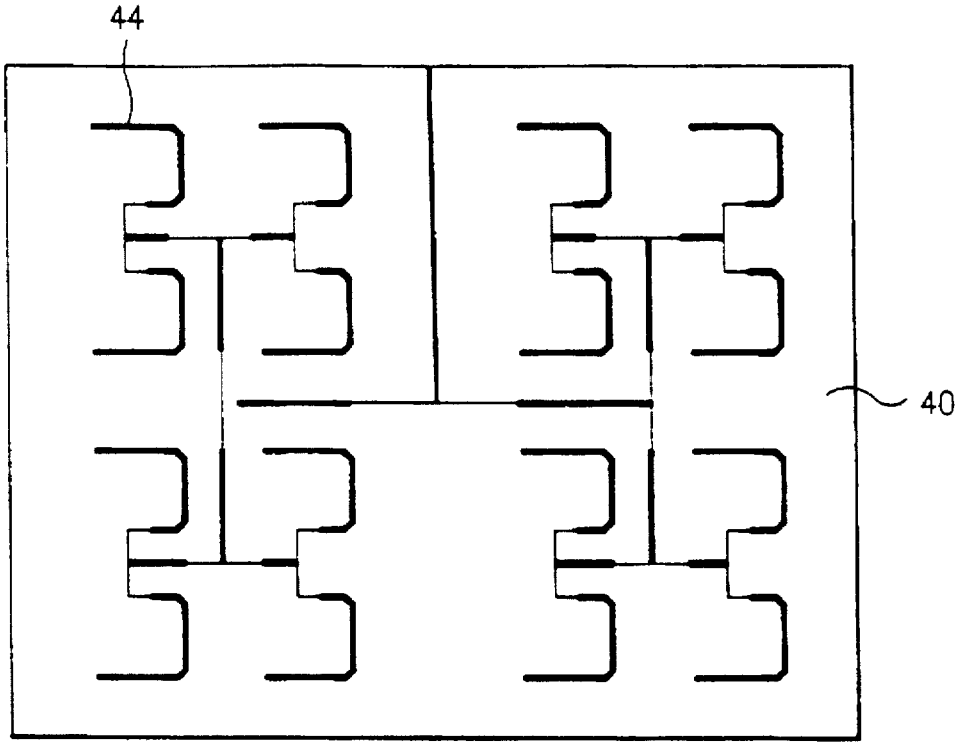
FIG. 12 is a plan view showing the electric power supplying circuit board of FIG. 11.

Electric power supplying circuit board 40, as shown in FIG. 12, is provided with electric power supply lines 44 for supplying the electromagnetic energy to the parasitic elements 43.

Identical to one embodiment of the flat antenna according to the present invention, radiating element substrate 31 is provided with a plurality of radiating elements 42 having a tap 42A and a cap 42B for radiating in two orthogonal modes, and electric power supply lines 36 for supplying the electromagnetic energy to radiating elements 42. Slot substrate 32 is formed with the plurality of parasitic elements 43 and rectangular slots 37 for the final radiation of the electromagnetic energy to radiating elements 42.

Figure 13A:
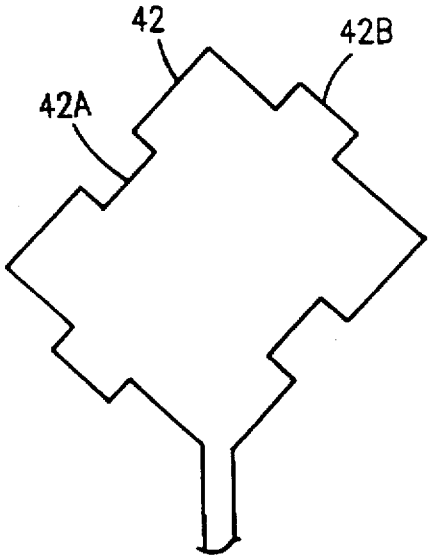
FIG. 13*a* is a plan view showing the radiating element for receiving left-handed circularly polarized wave of FIG. 11.
Figure 13B:
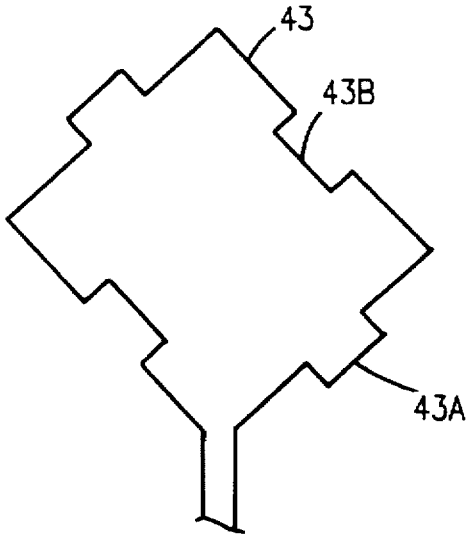
FIG. 13*b* is a plan view showing the parasitic element for receiving right-handed circularly polarized wave of FIG. 11.

At this time, radiating element 42 is formed with tap 42A and cap 42B for receiving a left-handed circularly polarized wave as shown in FIG. 13*a*, and parasitic element 43 is formed with a tap 43A and a cap 43B for receiving a right-handed circularly polarized wave as shown in FIG. 13*b*.

An operation of another embodiment of the flat antenna according to the present invention constructed as above will be described as below.

Radiating element 42 in radiating element substrate 31 formed as shown in FIG. 13*a* radiates the electromagnetic energy from electric power supply line 36 as the electromagnetic wave, and parasitic element 43 in slot substrate 32 formed as shown in FIG. 13*b* radiates the electromagnetic energy from electric power supply line 44 on electric power supplying circuit board 40.

In other words, radiating element 42 receives the left-handed circularly polarized wave, and parasitic element 43 receives the right-handed circularly polarized wave.

Figure 14:
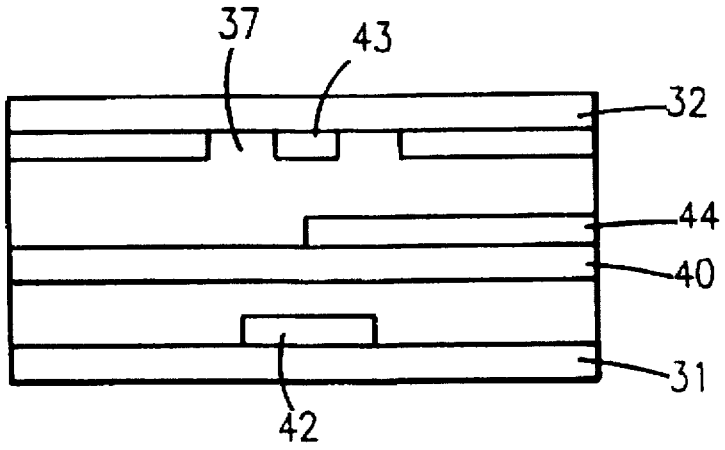
FIG. 14 is a sectional view showing a portion of the flat antenna of FIG. 11.
Figure 15:
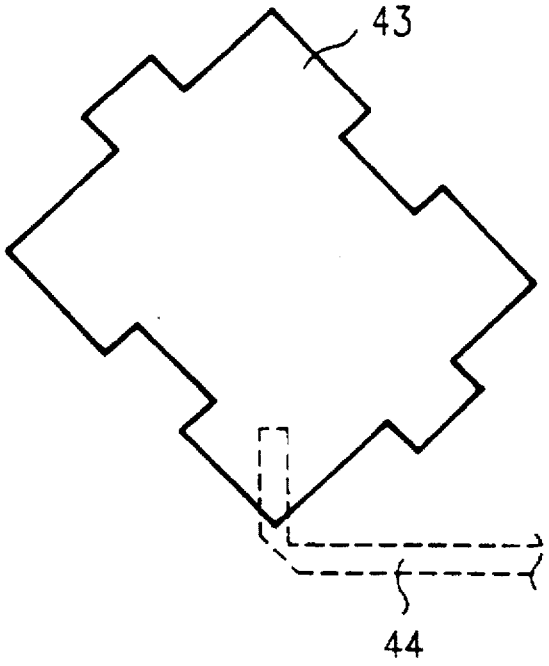
FIG. 15 is a view showing the coupling of the parasitic element with power supply line.

Here, parasitic element 43 for receiving right-handed circularly polarized wave is constructed to be separated from electric power supply line 44 which supplies the electromagnetic energy to parasitic element 43 as shown in FIG. 14, and the sites of electric power supply line 44 and parasitic element 43 correspond to each other for enabling the supply of the electromagnetic energy from electric power supply line 44 to parasitic element 43.

Therefore, adjacent two satellite broadcastings can be selectively received by radiating element 43 and parasitic element 43.

In the flat antenna according to the present invention as described above, a slot substrate having both rectangular slots and parasitic elements is employed to heighten efficiency of the antenna, and an electric power supplying circuit board is employed to enable selective reception of adjacent two satellite broadcastings.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A flat antenna structure comprising:

an earth conductor substrate;

a first foam agent stacked directly on and contacting said earth conductor substrate;

a radiating element substrate for radiating an electromagnetic wave, the radiating element substrate being stacked directly on and contacting said first foam agent and comprising radiating elements and electric power supply lines for supplying electromagnetic energy to the radiating elements;

a second foam agent stacked directly on and contacting said radiating element substrate; and a slot substrate stacked directly on and contacting said second foam agent and formed with a plurality of parasitic elements and rectangular slots for final radiation of said electromagnetic wave radiated from said radiating element substrate to block unnecessary radiation of said electromagnetic wave from said radiating element substrate, wherein each radiating element or parasitic element is a resonant structure having dimensions approximately equal to a half wavelength of the electromagnetic wave.

2. A flat antenna structure as claimed in claim 1, wherein the radiating elements each comprise a first tap and a first cap for radiating in two orthogonal modes.

3. A flat antenna structure as claimed in claim 2, wherein said radiating elements are shaped as rectangles.

4. A flat antenna structure as claimed in claim 2, wherein said radiating elements are shaped as circles.

5. A flat antenna structure as claimed in claim 2, wherein said two orthogonal modes are radiated in a phase difference of 90° having the same amplitude at a central frequency in accordance with the sizes of said first tap and first cap.

6. A flat antenna structure as claimed in claim 2, wherein said electric power supply lines comprise an impedance transformer at each branch for impedance matching and phase matching with said radiating elements.

7. A flat antenna structure as claimed in claim 2, wherein said radiating element substrate and slot substrate are stacked to allow said radiating elements and parasitic elements to oppose to one another.

8. A flat antenna structure as claimed in claim 7, wherein said parasitic elements are shaped the same as said radiating elements.

9. A flat antenna structure as claimed in claim 8, wherein said parasitic elements are formed to be smaller than said radiating elements.

10. A flat antenna structure as claimed in claim 7, wherein said parasitic elements number the same as said radiating elements.

11. A flat antenna structure as claimed in claim 1, further comprising an electric power supplying circuit board and a third foam agent stacked on said second foam agent for enabling selective reception of adjacent two satellite broadcastings.

12. A flat antenna structure as claimed in claim 11, wherein said radiating element substrate is provided with a plurality of radiating elements formed with a second tap and a second cap for radiating two orthogonal modes, and electric power supply lines for supplying said electromagnetic energy to said radiating elements.

13. A flat antenna structure as claimed in claim 12, wherein said radiating elements receive a left-handed circularly polarized wave, and said parasitic elements receive a right-handed circularly polarized wave.

14. A flat antenna structure as claimed in claim 11, wherein said electric power supplying circuit board is formed with electric power supply lines for supplying said electromagnetic energy to said parasitic elements.

* * * * *